United States Patent [19]

Goldin et al.

[11] 4,083,110

[45] Apr. 11, 1978

[54] FOLDABLE BLADE KNIFE

[75] Inventors: Jerry H. Goldin, Snellville; Walter W. Collins, Atlanta, both of Ga.

[73] Assignee: Collins Knives, Inc., Atlanta, Ga.

[21] Appl. No.: 792,666

[22] Filed: May 2, 1977

[51] Int. Cl.[2] ..... B26B 1/02

[52] U.S. Cl. ..... 30/155

[58] Field of Search ..... 30/153, 155, 161, 156, 30/157

[56] References Cited

U.S. PATENT DOCUMENTS

| | | | |
|---|---|---|---|
| 861,789 | 7/1907 | Zimmer | 30/153 |
| 971,057 | 9/1910 | Luce | 30/155 X |
| 1,397,018 | 11/1921 | Priestman | 30/155 |
| 1,994,215 | 3/1935 | Gaunt | 30/155 |
| 2,154,211 | 4/1939 | Madsen | 30/156 |

FOREIGN PATENT DOCUMENTS

| | | | |
|---|---|---|---|
| 100,224 | 11/1898 | Germany | 30/161 |

*Primary Examiner*—Jimmy C. Peters

*Attorney, Agent, or Firm*—Jones, Thomas & Askew

[57] ABSTRACT

The foldable blade knife comprises a blade with a tang positioned between the arms of a flat U-shaped handle at the ends of the arms away from the base of the handle, and a pivot pin extends through the arms of the handle and through the tang equidistant from the butt of the tang and the ends of the arms. The handle defines an opening sized and shaped to approximately correspond to the size and shape of the blade element, and at least one edge surface of the tang and the facing surface of an arm of the handle are formed in interfitting convex-concave shapes so that the resilient arms of the handle tend to hold the blade folded into the handle or to hold the blade extending out coextensively from the handle and when the handle is grasped by a hand, the gripping force by the hand tends to further lock the blade in its open or closed positions.

6 Claims, 3 Drawing Figures

FOLDABLE BLADE KNIFE

BACKGROUND OF THE INVENTION

This invention relates to a foldable blade knife wherein the blade pivots laterally with respect to the handle from its open position into an opening formed in the handle.

Foldable blade knives are usually constructed with a slotted handle and a blade foldable in its own plane with respect to the handle so that its cutting edge enters the handle slot first, and its dull back portion protrudes from the slot so that the person handling the knife can usually grasp the protruding back of the blade and pull it out of the slot to open the knife. These prior art knives are highly suitable to be carried by a person in his pocket since the handle functions as a shield with respect to the cutting edge and point of the blade, but knives of this type are not able to withstand the forces that can be withstood by a rigid blade knife, such as the typical hunter's knife. The pivot pin and leaf spring of the conventional folding blade knife are subject to deterioration and wear, and the blade of a foldable blade knife usually becomes loose after extended rugged use.

One of the problems encountered with the typical folding blade pocket knife is that the blade travels in the direction of its edge when it is being folded closed, and when a person using the knife exerts pressure on the back of the blade in a cutting operation, the blade is likely to fold and possibly cut the hand of ther user. Also, the typical folding blade knife includes not only the blade but two handles, two liners, two bolsters, a leaf spring, a blade pin, a pin at the pommel, and possibly four or more pins which hold the handle elements together. This complicated assembly requires expensive materials and a substantial amount of labor expense to assemble the knife, and once the knife has been assembled, the handle of the knife usually weighs substantially more than its blade. As the blade is sharpened over a period of use, the blade edge diminishes toward the back of the blade, so that the point of the blade is likely to emerge from the slot of the handle when the blade is closed into the handle, causing the person carrying the knife some hazard in handling the knife.

While the prior art suggests various side folding knife designs which do not include the problems listed above, one of the problems in previous side folding knives is the inadvertent folding of the blade with respect to the handle when the knife is used. This is most likely to occur when a lateral force is being applied to the blade, as when the blade was being used in a scrapping or prying action.

SUMMARY OF THE INVENTION

Briefly described, the present invention comprises a side folding knife of a type that is classifiable as a pocket knife, and which comprises an approximately U-shaped flat handle fabricated from resilient material, such as spring steel, and a blade that is connected at its tang to the arms of the handle with a pivot pin. The blade and handle are shaped so that the blade is snuggly received in the opening of the handle when the knife is closed, and the facing surfaces of the arms of the handle and the tang of the blade are shaped so as to lock the blade either in its closed or opened positions, and as additional gripping forces are applied to the handle as when the knife is being used, additional locking forces are exerted between the handle and blade to further reduce any hazard of the blade folding with respect to the handle.

The knife is fabricated from a small number of parts, and the handle, as well as the blade, is thin so that the knife structure occupies a small space in the pockets of garments, etc. and the weight of the handle is relatively small for a given blade size and weight by comparison to the weight of the handle of a conventional foldable blade pocket knife.

Thus, it is an object of this invention to provide a foldable blade knife that includes a blade and handle that folds with a sideways movement and which is inexpensive to construct, inexpensive to assemble, and which can be conveniently carried in the pocket of a garment, etc.

Another object of this invention is to provide a side folding knife wherein the handle and blade lock together when the blade is either folded into the handle or extended from the handle, and wherein gripping forces applied to the handle by the user of the knife tend to further increase the locking forces between the blade and the handle.

Other objects, features and advantages of the present invention will become apparent upon reading the following specification, when taken in conjunction with the accompanying drawings.

DESCRIPTION OF A PREFERRED EMBODIMENT

Figure 1:
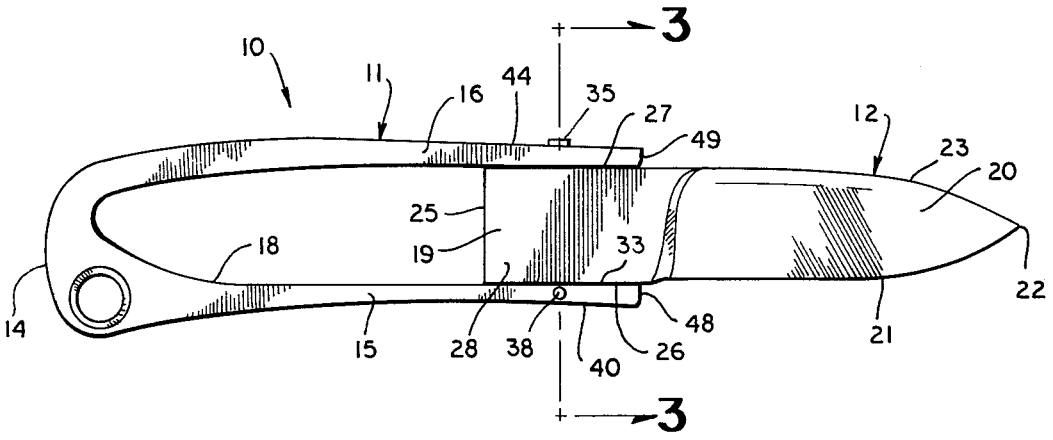
FIG. 1 is a side view of the foldable blade knife, showing the blade element opened outwardly from the handle.

Referring now in more detail to the drawings, in which like numerals indicate like parts throughout the several views, FIG. 1 illustrates the foldable blade knife 10 which comprises a handle 11 and blade elements 12. The handle 11 comprises a base 14 and a pair of arms 15 and 16 which extend from base 14 in parallel, spaced relationship. The arms 15 and 16 and base 14 of the approximately U-shaped handle 11 defines a blade receiving opening 18 which is sized and shaped to conform to the size and shape of the blade.

Blade element 12 includes a tang 19 and blade 20. The blade 20 includes a cutting edge 21, point 22 and back 23. Tang 19 includes a butt surface 25, a substantially flat base surface 26, a back surface 27, and parallel, substantially flat side surfaces 28 and 29.

Figure 3:
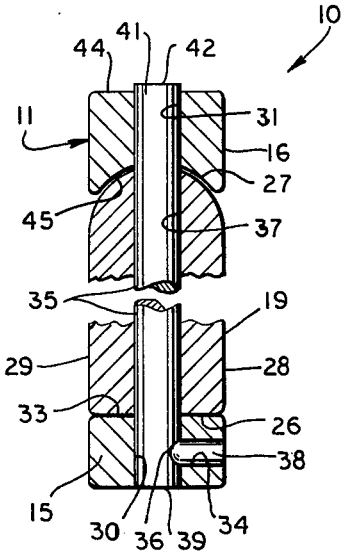
FIG. 3 is an end cross-sectional view of the knife, taken along lines 3—3 of FIG. 1, with portions of the blade removed for clarity.

As best illustrated in FIG. 3, the lower and upper arms 15 and 16 of handle 11 define aligned openings 30 and 31 therethrough with the longitudinal axis of opening 30 in the lower arm 15 being substantially perpendicular to the flat surface 33 of lower arm 15 which faces the tang 19, and tang 19 of blade element 12 defines an opening 32 therethrough which is substantially parallel to its flat side surfaces 28 and 29 and which is substantially perpendicular to its flat base surface 26. A laterally extending bore 34 is formed through the bottom arm 15 of handle 11 which intersects the opening 30. Pivot pin 35 extends through the aligned openings 30 and 31 of the arms 15 and 16 of handle 11 and through the opening 32 of tang 19, to hold the blade element 12 in the handle 11. The lower end portion of pivot pin 35 is partially drilled through to form indentation 36 therein, and a set pin 38 extends through the laterally extending bore 34 of the lower arm 15 and into the indentation 36 of the pivot pin 35, and the set pin 38 is peened on its outer surface to lock the set pin in the lower arm 15 and in the indentation 36 of the pivot pin 35. This locks the pivot pin 35 to the lower arm 15 and the upper arm 16 is free to move along the length of pivot pin 35.

The diameter of pivot pin 35 is substantially uniform along the length of the pivot pin except for the indentation 36, and the lower end 39 of the pivot pin 35 is ground flush with the bottom external surface 40 of the lower arm 15. The upper end portion 41 of pivot pin 35 extends well into the opening 31 in the upper arm 16 of the handle, and its upper surface 42 can be ground flush with the exterior upper surface or back 44 of the handle when the blade is locked open or closed so that no protrusions appear on the back of the handle.

Figure 2:
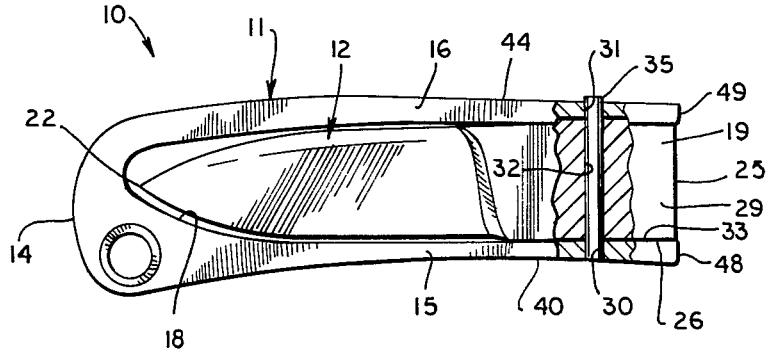
FIG. 2 is a side elevational view similar to FIG. 1, but showing the blade element folded into its closed relationship with respect to the handle.

The shape of the back surface 27 of tang 19 is convex or dome shaped in cross-section (FIG. 3), and the shape of the facing inner surface 45 of the upper arm 16 of handle 11 is concave and complimentary to the shape of the back of the tang, so that the shapes interfit as illustrated in FIG. 3 when the blade element 12 is either in its fully-extended position where it is parallel to the handle 11 as illustrated in FIG. 1, or where the blade is folded to its closed position in the handle as illustrated in FIG. 2.

The handle 11 is fabricated from resilient material, such as spring steel, and the size of tang 19 of the blade element 12 requires some spreading of the arms 15 and 16 when the tang is first received between the arms, so that the arms 15 and 16 are spring biased into engagement with the base surface 26 and the back surface 27 of the tang. When the blade element 12 is pivoted with respect to handle 11, the convex-concave interfitting relationship between the back surface of tang 19 and the facing inner surface of arm 16 of the handle causes the arms 15 and 16 to spread further apart as the back of the tang and facing surface of the upper arm move out of their interfitting relationship. The blade and handle are then very easily pivoted with respect to each other and about pivot pin 35 until the back surface 27 of the tang and the facing interfitting surface 45 of the upper arm 16 move back into interfitting relationship.

The convex-concave interfitting shapes of both the back surface 27 of the tang 19 and the facing surface 45 of the upper arm 16 of the handle 11 extend on both sides of pivot pin 35, so that a locking effect is created on both sides of the pivot pin.

The opening 32 through the tang 19 of blade element 12 and the aligned openings 30 and 31 through the lower and upper arms 15 and 16 of the handle 11 are equidistance from the butt surface 25 of blade element 12 and from the ends 48 and 49 of lower and upper arms 15 and 16 of handle 11, so that when the blade element 12 is moved to its closed position with respect to handle 11 (FIG. 2), the butt surface 25 will be substantially coextensive with the ends 48 and 49 of the arms 15 and 16 of the handle.

When the knife is opened and in use, the hand of the person gripping the handle 11 usually tends to urge the arms 15 and 16 together, and these gripping forces tend to further lock the blade element 12 with respect to the handle 11 and to further assure that the blade element 12 is not likely to pivot with respect to the handle when the knife is in use.

While this invention has been described in detail with particular reference to a preferred embodiment thereof, it will be understood that variations and modifications can be effected within the spirit and scope of the invention as described hereinbefore and as defined in the appended claims.

We claim:

1. A knife comprising an approximately U-shaped handle fabricated from resilient material including a base portion and a pair of arms extending in spaced, approximately parallel relationship with respect to each other from said base portion, a knife blade element formed as a tang at one end and a blade at the other end, said tang positioned between the arms of said handle at the ends of said arms away from the base portion of said handle, a pivot pin extending through the arms of said handle and through the tang of said blade element, said pivot pin being located approximately equidistant from the butt of the tang and the ends of the arms, the base portion and pair of arms of said handle defining an opening sized shaped to approximately correspond to the size and shape of said blade element, at least one edge surface of said tang and the facing surface of an arm of said handle being formed in interfitting convex-concave shapes when the blade is located in the opening of the handle or when the blade extends out coextensively from the handle, whereby the interfitting convex-concave shapes of the tang and handle and the resiliency of the handle tend to hold the blade folded into the handle or to hold the blade extending out coextensively from the handle and whereby the butt of the tang is approximately coextensive with the ends of the arms of the handle when the blade is folded into the handle.

2. The knife of claim 1 and wherein the interfitting convex-concave shapes of the tang and of the arm of the handle extend on both sides of said pivot pin.

3. The knife of claim 1 and wherein the butt of the tang of said blade element is substantialy flat and aligns with the ends of the arms of said handle when the blade is folded into the opening of the handle.

4. The knife of claim 1 and further including means for anchoring said pivot pin in one of the arms of said handle.

5. The knife of claim 1 and further including a set pin extending through one of the arms of said handle and into engagement with said pivot pin for holding said pivot pin in place.

6. A knife comprising an approximately U-shaped handle of resilient material including a base and approximately parallel arms extending from said base, a substantially flat blade element including a tang at one of its ends and a cutting blade at its other end, said tang being inserted between the arms of said handle, said tang including a substantially flat base surface, a butt surface, a back surface, and substantially flat parallel side surfaces, said tang defining an opening therethrough with said opening being substantially parallel to said side surfaces and substantially perpendicular to said base surface, the arms of said handle defining aligned openings therein, and a pivot pin inserted through the aligned openings of said arms and the opening through said tang, means for holding said pivot pin in one of the arms of said handle with the other arm movable along the length of said pivot pin, the back surface of said tang and the facing surface of the arm of said handle being of complementary interfitting convex-concave configurations, whereby when the blade element is pivoted with respect to said handle from a position parallel to said handle the arms of said handle spread further apart as the interfitting convex-concave shapes of the back of the tang and facing surface of the arm of the handle move out of their interfitting relationship and one of the arms of the handle moves longitudinally along the pivot pin, and when the blade element is pivoted into a position parallel to said handle the arms of the handle move toward each other as the interfitting convex-concave shapes of the back of the tang and facing surface of the arm of the handle move into their interfitting relationship.

* * * * *